US005844180A

United States Patent [19]

Liebetrau et al.

[11] Patent Number: 5,844,180

[45] Date of Patent: Dec. 1, 1998

[54] EQUIPMENT FOR THE PRODUCTION OF ELEVATOR SHAFT INFORMATION

[75] Inventors: Christoph Liebetrau, Ménziken; Frederic T. Nlabu, Sempach Stadt, both of Switzerland

[73] Assignee: Inventio AG, Hergiswil NW, Switzerland

[21] Appl. No.: 672,336

[22] Filed: Jun. 28, 1996

[30] Foreign Application Priority Data

Jun. 30, 1995 [CH] Switzerland ..... 01923/95

[51] Int. Cl.[6] ..... B66B 1/36; B66B 1/34

[52] U.S. Cl. ..... 187/394; 187/283

[58] Field of Search ..... 187/279, 282, 187/283, 291, 292, 294, 391, 2, 393, 394, 317

[56] References Cited

U.S. PATENT DOCUMENTS

| | | | |
|---|---|---|---|
| Re. 33,668 | 8/1991 | Gray | 250/221 |
| 3,743,056 | 7/1973 | Zitelli et al. | 187/394 |
| 4,134,476 | 1/1979 | Zolnerovich, Jr. et al. | 187/394 |
| 4,245,721 | 1/1981 | Masel | 187/394 |
| 4,493,399 | 1/1985 | Kajiyama | 187/394 |
| 5,659,159 | 8/1997 | Koopman, Jr. | 187/292 |

FOREIGN PATENT DOCUMENTS

| | | | |
|---|---|---|---|
| 2409543 | 6/1979 | France | B66B 1/50 |
| 2262396 | 6/1974 | Germany | B66B 1/50 |

OTHER PUBLICATIONS

International Search Report.

*Primary Examiner*—Robert Nappi
*Attorney, Agent, or Firm*—Greenblum & Bernstein P.L.C.

[57] ABSTRACT

A device for monitoring the positioning an elevator cage within an elevator shaft. A light curtain with several light beams extends over a length of a cage threshold and along a height of a cage door. The light curtain may be produced by a first transmitter strip and a receiver strip and may be utilized as a security device to block operation of the elevator cage when persons or objects are in a region of the cage doors or story doors. Each light transmitter may lie opposite a respective light receiver so that each light beam from each light transmitter may be incident upon a respective light receiver. A pivotable masking plate may be mounted on a receiver strip side of a story threshold to project into the light curtain such that at least one light beam may be incident upon the masking plate instead of its respective light receiver. The interrupted light beam may be indicative of the actual position of the elevator cage. A correction magnitude utilized for properly adjusting the elevator cage from a coarse position to a target position may be determined from a predetermined target value and an actual value of the elevator cage position.

19 Claims, 5 Drawing Sheets

EQUIPMENT FOR THE PRODUCTION OF ELEVATOR SHAFT INFORMATION

CROSS REFERENCE OF RELATED APPLICATION

The present application is based upon Swiss Patent Application No. 01 923/95-7, filed Jun. 30, 1995, the disclosure of which is incorporated by reference herein in its entirety.

BACKGROUND OF THE INVENTION

1. Field of the Invention

The present invention relates to an apparatus for producing elevator shaft information. The apparatus may include information transmitters arranged in the door region of an elevator cage and actuating elements arranged in the door region of a story door. The information transmitters may be actuated according to the position of the elevator cage in an elevator shaft.

2. Discussion of Background Information

A shaft information transmitter which includes vertically arranged switches, i.e., one above the other, on the door side of the cage and a contact tag (or switch-over magnets) arranged at the door post of the story door, has been disclosed in DE 2 262 396. On the arrival of the cage at a particular story, the switches arranged on the cage are actuated in succession, i.e., one after the other, by the contact tag (or switch-over magnets) of the story door post. The switch signals are used by an elevator control for switching functions such as changing-over speed, fine setting-down, onset of braking, further switching of the stepping switch mechanism and so forth.

A disadvantage of the known shaft information transmitter is that the switches in the region of the cage door and the contact tag in the region of the story door require a significant amount of space and are constructionally difficult to accommodate. Moreover, the accuracy of the switch signals may be adversely affected by the hysteresis of the switches.

SUMMARY OF THE INVENTION

The present invention avoids the disadvantages of the above-noted shaft information transmitter by providing a shaft information transmitter arranged at an elevator cage that is easily accommodated even in tightly dimensioned shaft cross-sections or entry regions. The signals generated by the present invention enable the elevator cage to be positioned very precisely at each story.

According to the present invention, existing safety systems of the cage door region may be utilized for producing shaft information, the shaft information transmitter may be utilized for producing travel signals for the control of the lift drive, and data may be transmitted between the cage and story doors by the shaft information transmitter.

Accordingly, the present invention may be directed to an apparatus for the production of shaft information in an elevator system. The apparatus may include a plurality of information transmitters arranged in a region of an elevator cage door and a plurality of actuating elements arranged in a region of a story door. Each of the plurality of actuating elements actuate an information transmitter according to a position of an elevator cage in an elevator shaft and each of the plurality of information transmitters may include opto-electronic information transmitters.

According to another feature of the present invention, the apparatus may also include a first transmitter strip, extending substantially over a height of the elevator cage door and producing a light curtain. The first transmitter strip may include each of the plurality of light transmitters vertically arranged one above the other. The apparatus may also include a receiver strip, extending substantially over the height of the elevator cage door. The receiver strip may include a plurality of light receivers vertically arranged one above the other. Each of the plurality of light receivers may convert a light beam of each of the plurality of light transmitters into an electrical signal and each of the plurality of actuating elements may include a masking plate for interrupting an individual light beam arranged in the region of the story door and projecting into the light curtain.

According to another feature of the present invention, a lowest positioned light transmitter of the first transmitter strip and a lowest positioned light receiver of the receiver strip may be arranged at a cage threshold and the masking plate may be arranged at a story threshold.

According to a further feature of the present invention, the masking plate may be pivotably arranged at the story threshold and may include a tag for actuating the masking plate.

According to yet another feature of the present invention, the masking plate may be positioned for pivoting about a pin and the tag may be actuatable by the story door.

According to still another feature of the present invention, the system may also include a device for ascertaining a coarse position of an elevator in relation to each story according to a learning journey of the elevator cage and may include a positioning device for ascertaining an exact target position according to a manual learning journey. The elevator may be positioned in the exact target position according to individual light beams being interrupted by one of the plurality of masking plates and a correction magnitude determined by an actual value of a travel command and a target value related to the exact target position of the manual learning journey.

According to yet another feature of the present invention, the system may also include a second transmitter strip arranged in parallel adjacent the receiver strip, and a first receiver diode, a second receiver diode, and a transmitter diode arranged on the masking plate. The first receiver diode positioned for receiving a light beam from the transmitter strip, the second transmitter strip and the second receiver diode positioned to transmit data in a first direction, and the transmitter diode and the receiver strip positioned to transmit data in a second direction. A story computer may be utilized for receiving data transmitted to the second receiver diode and for transmitting data via the transmitter diode and a cage computer may be utilized for receiving data transmitted to the receiver strip and for transmitting data via the second transmitter strip.

Another aspect of the present invention is directed to an apparatus for use in an elevator system for positioning an elevator with respect to each of a plurality of story thresholds. The elevator system may include an elevator shaft, an elevator cage for traversing the elevator shaft and a plurality of stories, each of the stories including a story threshold. The apparatus may include a light curtain including a plurality of light beams formed within the elevator cage and parallel to the story threshold, and a plurality of masking plates, each positioned for interrupting at least one of the plurality of light beams. The at least one interrupted light beam may be indicative of an actual position of the elevator.

According to still another feature of the present invention, one of the plurality of masking plates may be mounted on each of the story thresholds.

According to yet another feature of the present invention, the light curtain may include a plurality of light transmitters and a plurality of light receivers. The system may also include a cage controller for receiving a signal from each of the plurality of light receivers.

According to still another feature of the present invention, the system may also include an elevator controller for receiving a signal from the cage controller, for determining a coarse position of the elevator, and for determining a correction magnitude. The correction magnitude may be utilized for accurately positioning the elevator in the elevator shaft from the determined coarse position.

According to a further feature of the present invention, the system may also include a plurality of second light transmitters mounted to the elevator cage adjacent the plurality of light receivers. Each of the plurality of masking plates may include a first receiver for receiving the at least one interrupted beam, a first transmitter for transmitting a predetermined signal to a masked light receiver, and a second light receiver for receiving a signal from at least one of the plurality of second light receivers.

According to yet another feature of the present invention, the system may also include a story computer and a cage computer. The story computer may be coupled to the second receiver for receiving a signal transmitted from the cage computer. The cage computer may be coupled to the plurality of light receivers for receiving a signal from the story computer.

According to a further feature of the present invention, the first transmitter and the plurality of second transmitters may transmit pulse data.

According to another feature of the present invention, the masking plate may include an open and a closed position. In the open position, the masking plate may operate as a safety element. In the closed position, the masking plate may operate as an elevator positioning element.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENT

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
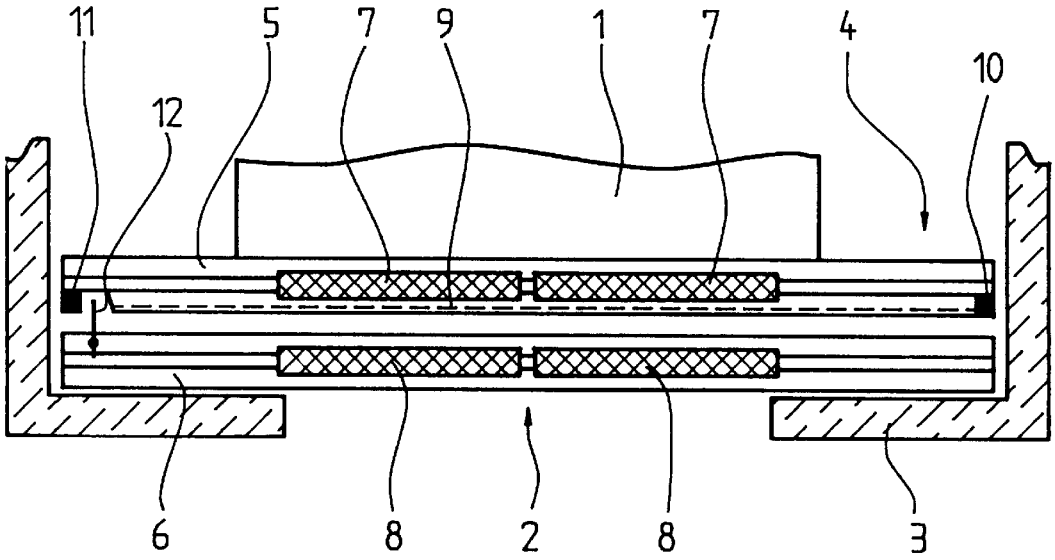
FIG. 1 shows a plan view of an entry/exit of an elevator with a light curtain.

An elevator cage 1, shown in FIG. 1, may be moved in an elevator shaft 4 formed by shaft walls 3. The elevator cage 1 is positioned at a story 2 of the elevator. On stopping at a predetermined story, the position of the elevator cage 1 may be regulated so that a cage threshold 5 stands flush with a story threshold 6. A cage door 7 may be moved along cage threshold 5 and a story door 8 may be moved along story threshold 6. Cage door 7 may be opened and closed by a door drive (not shown) and story door 8 may be opened and closed by corresponding entraining members arranged at cage door 7 (not shown).

A light curtain 9 may be positioned to extend over the length of the cage threshold 5 and along the height of cage door 7 and may include a first transmitter strip 10 and a receiver strip 11. When persons or objects are positioned within the light curtain 9, i.e., the story and cage doors are opened for the ingress and egress of passengers, etc., the cage doors 7 may be prevented from closing and elevator cage 1 may be prevented from operating. First transmitter strip 10 may be arranged at one end of cage threshold 5 to extend along the height of the cage and may include a plurality of light sources, e.g., 16 sources, operating, e.g., in the infrared range. Beams produced by the plurality of light sources may be detected by a corresponding plurality of light receivers, e.g., 16 receivers, comprising the receiver strip 11 which may be arranged at the opposite end of cage threshold 5. A respective light source may be positioned opposite each light receiver so that a light beam from one light source may be incident upon a corresponding one light receiver. Each light receiver may comprise, e.g., a photodiode for converting the light beam into an electrical signal. When at least one light beam is interrupted, e.g., by persons, objects, etc., cage 1 remains blocked.

Figure 2:
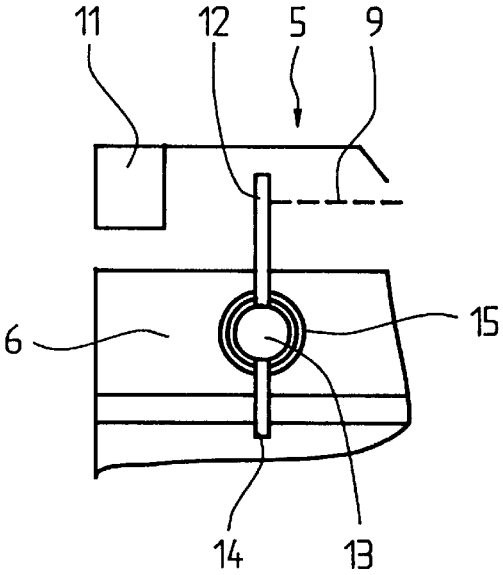
FIG. 2 shows a plan view of a masking plate pivotably arranged at a story door threshold.
Figure 3:
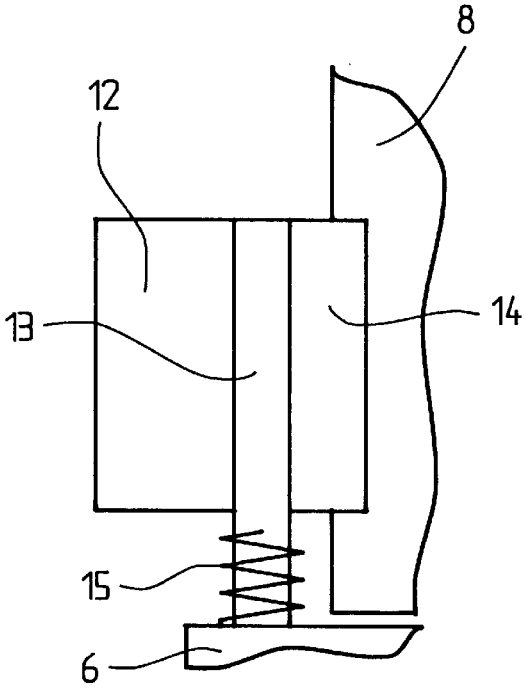
FIG. 3 shows a side elevation of the masking plate according to FIG. 2.
Figure 4:
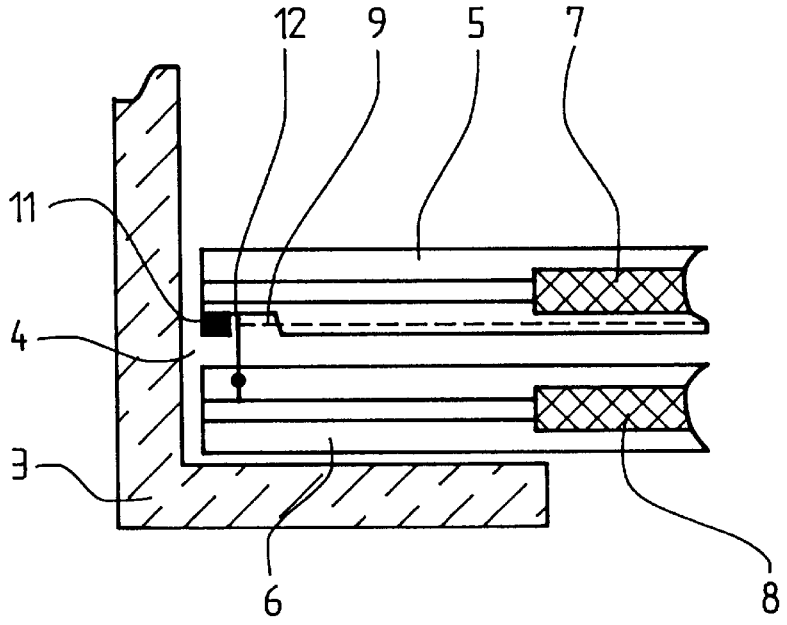
FIG. 4 shows the masking plate at a rest position with the story door closed.
Figure 5:
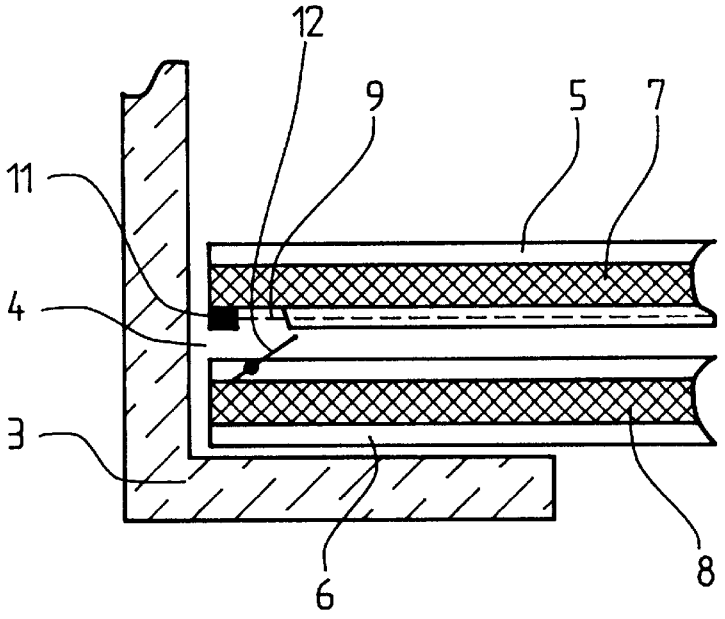
FIG. 5 shows the masking plate actuated by the open story door.

A masking plate 12 may be positioned to project into the light curtain 9, as shown in FIGS. 2 and 4. Masking plate 12 may be mounted on the receiver strip side of story threshold 6, i.e., the side of story threshold 6 that corresponds to the side of cage 1 that includes receiver strip 11. When masking plate 12 projects into light curtain 9, a light beam is incident on masking plate 12 instead of on its corresponding light receiver of receiver strip 11 (see FIGS. 2 and 4). In the present example of embodiment, the masking plate 12, as shown in FIGS. 2 and 3, is arranged to pivot about an axis point 13, e.g., a fixed or rotating pin. When the cage doors 7 and the story doors 8 are closed (e.g., as shown in FIG. 4), masking plate 12 projects into the light curtain 9 and blocks a light beam from a light receiver of strip 11. During an opening operation of doors 7 and 8 (e.g., as shown in FIG. 5), one of the story doors 8 may contact a tag 14 extending from masking plate 12 opposite pin 13 for rotationally moving, i.e., pivoting, masking plate 12 out of the light curtain 9, and specifically, out of the light beam. During a closing operation of doors 7 and 8, pin 13 may rotate back into its initial position, e.g., as in FIG. 4, under the force influence of resilient member 15, e.g., a spring, so that masking plate 12 may again project into light curtain 9 before elevator cage 1 may be enabled by control circuitry to travel to another story. Alternatively, resilient member 15 may be replaced with a driver to impart pivotal movement of masking plate 12.

The pivotable masking plate 12 may enable a dual function advantage over prior systems. When the cage door 7 is open, the light curtain 9 may enable unimpaired operation as a safety element. That is, neither the cage doors nor the story doors may close if a beam of light curtain 9 is interrupted. When cage door 7 is closed, masking plate 12 may be utilized for determining proper positioning of the elevator cage 1 with respect to a predetermined story and threshold.

In an alternative embodiment, a fixed masking plate 12 may be provided, i.e., non-pivoting. In this embodiment, at least one light beam may be interrupted when doors 7 and 8 are open. The control device must be able to distinguish whether it is an object or masking plate 12 that is interrupting the light beam.

Figure 6:
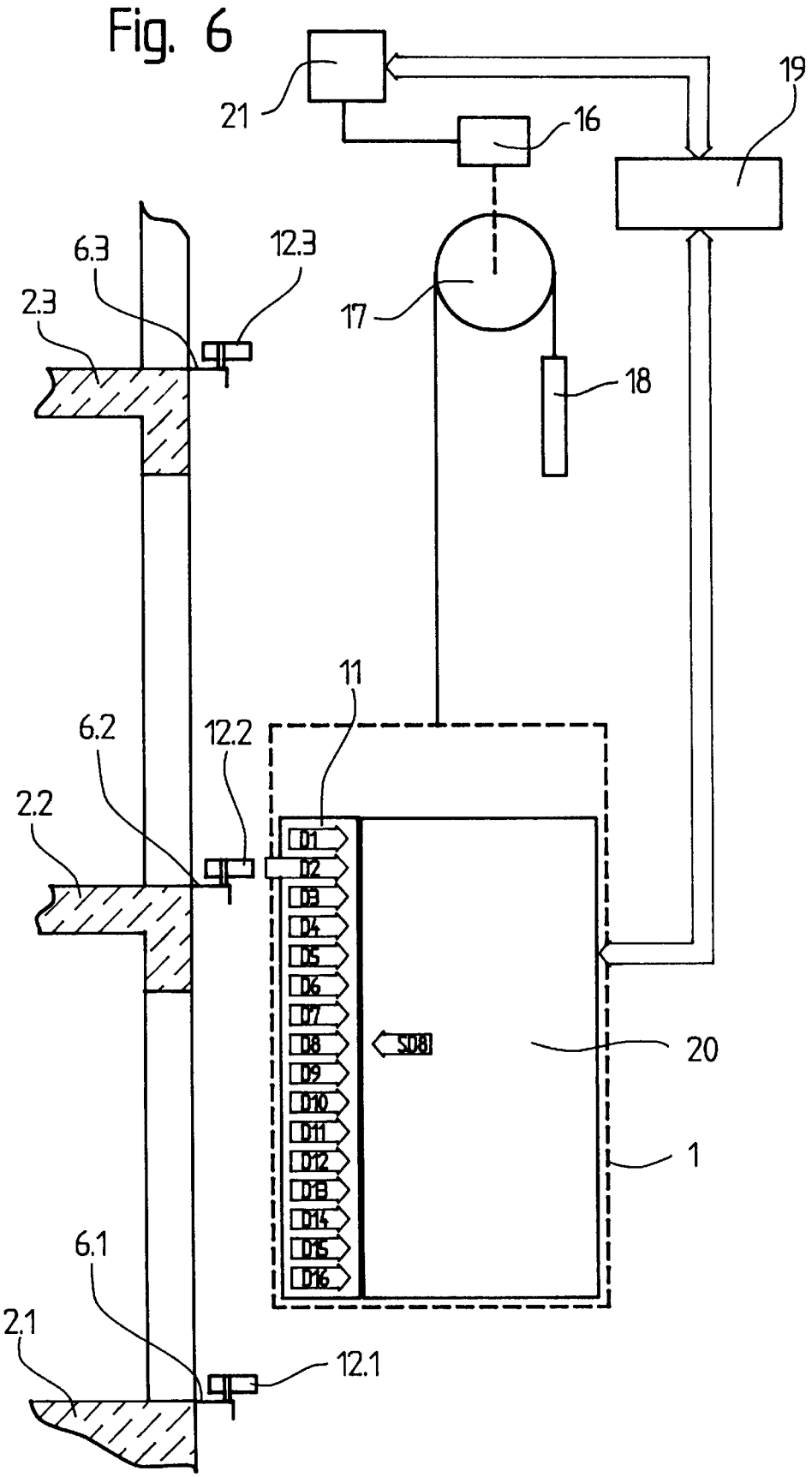
FIG. 6 shows a schematic illustration of a shaft information transmitter for the positioning of an elevator cage.
Figure 7:
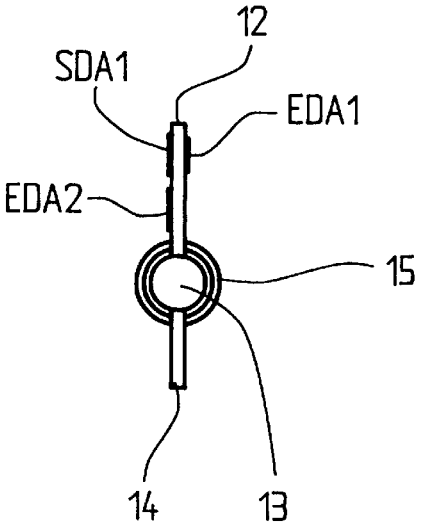
FIG. 7 shows a plan view of the masking plate, which is pivotably arranged at the story door threshold, with transmitter and receiver diodes.
Figure 8:
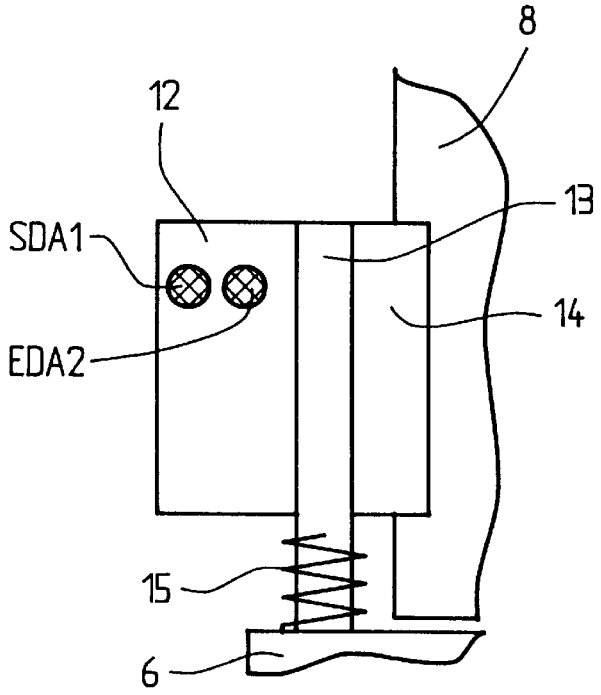
FIG. 8 shows a side elevation of the masking plate according to FIG. 7.

FIG. 6, showing an elevator installation of the preferred embodiment of the present invention, may include several stories 2.1, 2.2 and 2.3. Each story may include a respective masking plate 12.1, 12.2 and 12.3, and a respective story threshold 6.1, 6.2 and 6.3. The installation may also include a motor 16 for driving a drive pulley 17. Drive pulley 17 imparts vertical movement on cage 1 and correspondingly opposite movement on elevator counterweight 18 in elevator shaft 4. An elevator control 19 may be utilized for a two-way data and control command exchanges with a cage control 20 and a motor control 21. Elevator control 19 may include a microprocessor and memory device for storing certain data, e.g., cage position data. The light beams of light curtain 9 may be incident on the light receivers, e.g., photodiodes D1 to D16 of receiver strip 11. The incident light beams may be converted by the light receivers into electrical signals to be evaluated by cage control 20. In a situation in which one or more light receivers fail to deliver an appropriate electrical signal to cage control 20, cage control 20 transmits a blocking signal to elevator control 19 to block movement of elevator cage 1 until all travel conditions, e.g., receiving each beam of light curtain 9 at light receiver strip 11, are fulfilled.

According to the present invention, the precise location or position of elevator cage 1 may be ascertained by elevator control 19. By accessing an elevator control memory, elevator control 19 may compare signals received from cage control 20 with the stored cage position data. However, before such precise positioning information may be determined, elevator cage 1 may execute a learning journey by travelling to each story, e.g., 2.1, 2.2 and 2.3, available in elevator shaft 4. In the example shown in FIG. 6, the current position of cage 1 may be determined in relation to story 2.2. In this position, masking plate 12.2 may, for example, mask a second light receiver, e.g., photodiode D2. This coarse position of cage 1 may be stored in the memory device of elevator control 19. An exact position may be arrived at by manually driving cage 1, in a second journey, to a position in which a predetermined target position, e.g., SD8, is aligned with masking plate 12.2. In the present example, target position SD8 corresponds to aligning light receiver D8 with masking plate 12.2.

Once all coarse and exact position information is stored in the memory of elevator control 19, when elevator cage 1 receives a travel command, for example, to go to story 2.2, elevator control 19 may send a signal to motor control 21 to drive the elevator cage toward story 2.2. As elevator cage 1 traverses the elevator shaft 4 toward its destination, each elevator cage sensor is successively interrupted by a masking plate. That is, assuming that the elevator cage is ascending toward story 2.2 from a location below story 2.1, as elevator cage 1 approaches (and passes) story 2.1, masking plate 12.1 may project into light curtain 9 of the elevator cage and successively interrupt each passing light beam. As elevator cage 1 approaches story 2.2, masking plate 12.2. may project into the light curtain 9 to successively interrupt each passing light beam. Thus, as elevator cage 1 moves into the coarse position defined as story 2.2 during the learning journey, i.e., by approximately aligning the second light receiver with the masking plate 12.2, the cage control 20 may transmit a signal to elevator control that the cage has arrived at the coarse position. However, because of the speed of the moving cage 1, the coarse position may be an approximate aligning of the second light receiver and the masking plate 12.2, e.g., third light receiver D3, may be actually aligned with the masking plate 12.2. This actual alignment of D3 and masking plate 12.2 may be detected by cage control 20 and may be transmitted to elevator control 19 as an actual value. Elevator control 19 may discern the difference between the actual value (i.e., transmitted from cage control 20) and the target value for proper positioning of cage 1 at target position D8. This difference may be referred to as, e.g., a correction magnitude, to indicate the amount of additional movement to be imparted to cage 1 via motor 16 through motor control 21 to align the target position SD8 and the masking plate 12.2.

In FIGS. 7–10, the positioning equipment shown in FIGS. 1–6 may be alternatively arranged to include a special masking plate and a second transmitter strip 22. According to this alternative embodiment, data may be transmitted/received in the door region, thus ensuring light curtain 9 as a constant safety element. At the transmitter strip side of the cage, masking plate 12 may be implemented with a light receiver EDA1, e.g., receiver photodiode. Light receiver EDA1 may replace the at least one diode in receiver strip 11 to be covered by masking plate 12. At the receiver strip side of cage 1, masking plate 12 may be implemented with a light transmitter SDA1, e.g., a transmitter diode and a second receiver light EDA2 which may also be implemented with a receiver photodiode. At cage threshold 5, a second transmitter strip 22 (shown in FIG. 9) may be arranged adjacent receiver strip 11. Transmitter SDA1 may send data that relates to, e.g., the story that the elevator is encountering, and the second transmitter may send data relating to which sensor on the elevator cage is currently "blocked" by the masking plate, i.e., indicating the position of the elevator cage 1 with respect to the story threshold.

Figure 9:
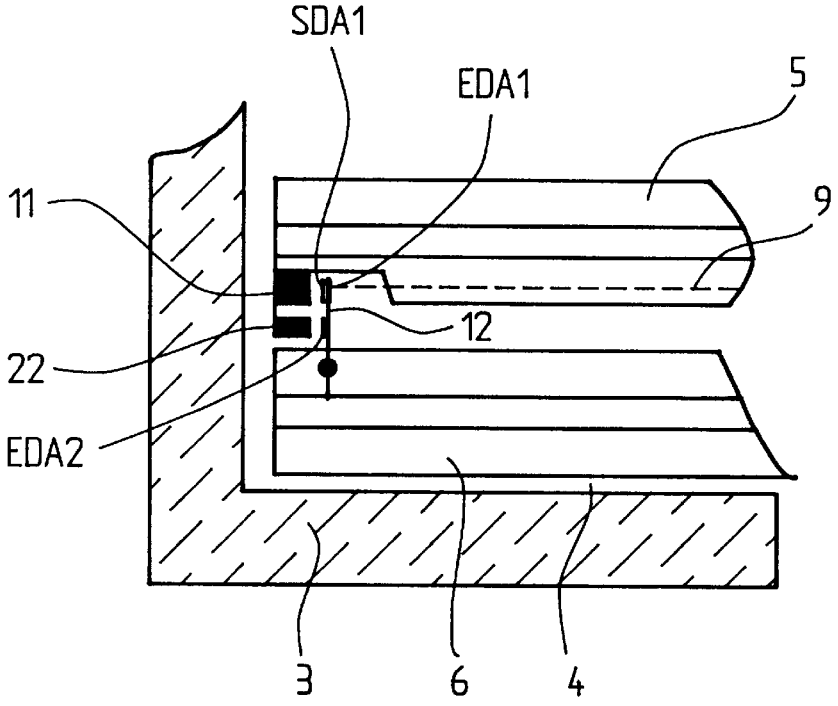
FIG. 9 shows an equipment for data transmission between the elevator cage and the story.
Figure 10:
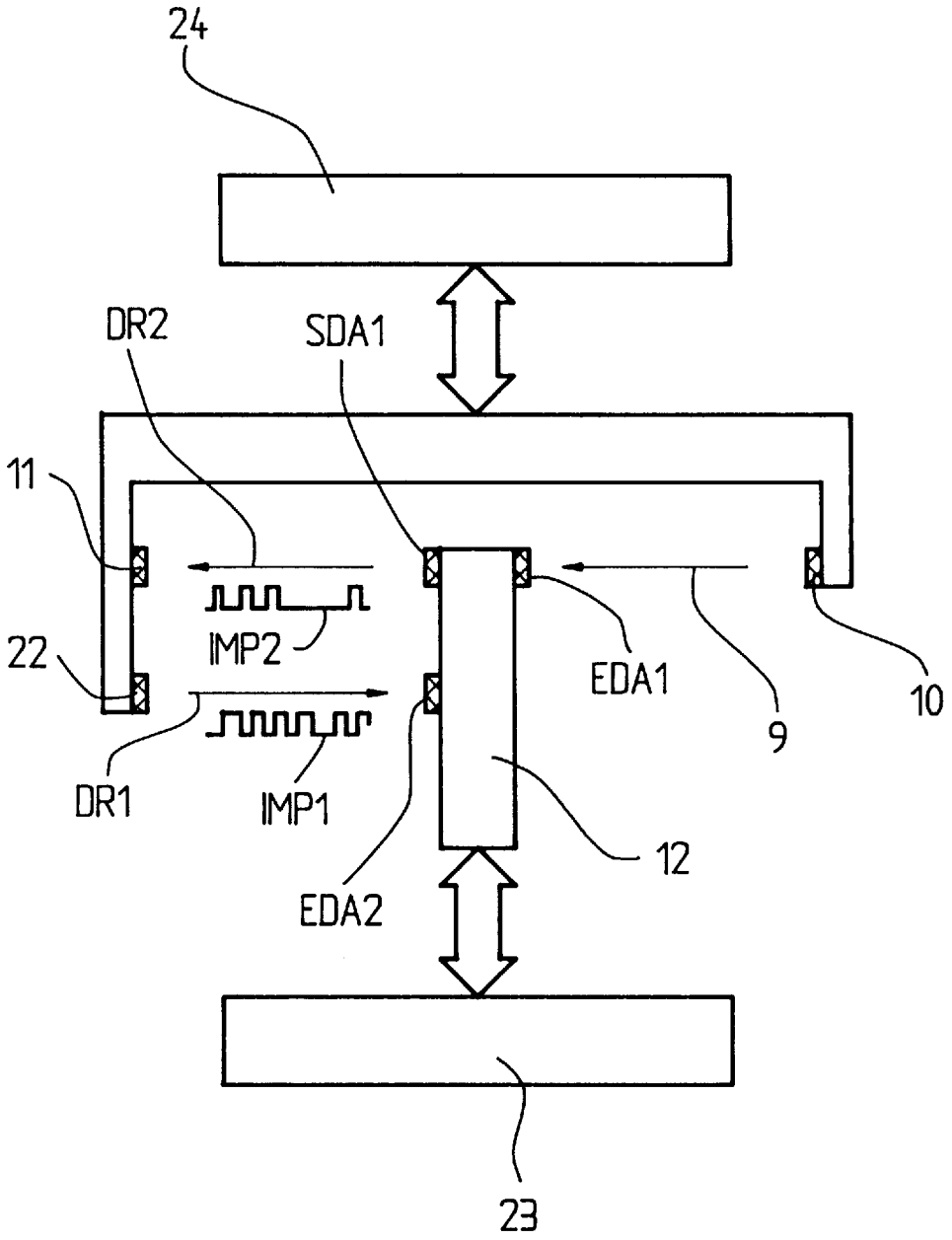
FIG. 10 shows a block schematic diagram for data transmission between a cage computer and a story computer.

Data transmission according to this alternative embodiment may be carried out as illustrated in FIG. 10. The light curtain 9 may be blocked by masking plate 12 as the elevator cage traverses the elevator shaft. That is, the arrival and passing of the elevator cage 1 with respect to a story may be determined by a respective masking plate which may be mounted on a respective story threshold to intercept the light curtain 9 as the elevator cage 1 passes by. As shown in FIGS. 9 and 10, for a given instantaneous position of elevator cage 1 in which masking plate 12 interrupts a beam of light curtain 9, light curtain 9 may be created by transmitting from a transmitter of first transmitter strip 10 to light receiver EDA1. Further data transmissions may be produced from light transmitter SDA1 to light receiver strip 11 and from second transmitter strip 22 to second light receiver EDA2.

Thus, data transmission occurs between elevator cage 1 and story 2 when light curtain 9 is blocked by masking plate 12. In such an instantaneous position, a diode on each of transmitter strips 10 and 22 and a diode on receiver strip 11 may be positioned opposite elements EDA1, EDA2 and SDA1, respectively, of masking plate 12. The data may be transmitted unidirectionally, e.g., DR1 and DR2. Further, the transmission and reception of data may occur at substantially the same time. The transmitted data may be converted by a story computer 23 or by a cage computer 24 into pulses IMP1 and IMP2 and transmitted by the diodes, e.g., opti-electronically. For example, the story computer 23 may be coupled to the first light receiver EDA2 and to light transmitter SDA1, and the cage computer 24 may be coupled to each of the light receivers in first receiver strip 11 and to each of the light transmitters in second transmitter strip 22. In this arrangement, the story computer and cage computer may communicate with each other to ascertain position data related to the position of the elevator cage with respect to the story threshold.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. An apparatus for the production of shaft information in an elevator system comprising:

a plurality of information transmitters of an existing safety system arranged in a region of an elevator cage door; and a plurality of actuating elements arranged in a region of a story door;

each of said plurality of actuating elements for actuating an information transmitter according to a position of an elevator cage in an elevator shaft, wherein each of said plurality of information transmitters comprise opto-electronic information transmitters.

2. An apparatus for the production of shaft information in an elevator system comprising:

a plurality of information transmitters arranged in a region of an elevator cage door;

a plurality of actuating elements arranged in a region of a story door; and each of said plurality of actuating elements for actuating an information transmitter according to a position of an elevator cage in an elevator shaft, wherein each of said plurality of information transmitters comprise opto-electronic information transmitters;

a first transmitter strip, extending substantially over a height of said elevator cage door and producing a light curtain, comprising each of said plurality of information transmitters vertically arranged one above the other;

a receiver strip, extending substantially over the height of the elevator cage door, comprising a plurality of light receivers vertically arranged one above the other;

each of said plurality of light receivers for converting a light beam of each of said plurality of information transmitters into an electrical signal; and each of said plurality of actuating elements comprising a masking plate for interrupting an individual light beam arranged in said region of said story door and projecting into said light curtain.

3. The apparatus according to claim 2, a lowest positioned information transmitter of said first transmitter strip and a lowest positioned light receiver of said receiver strip being arranged at a cage threshold and said masking plate being arranged at a story threshold.

4. The apparatus according to claim 3, said masking plate being pivotably arranged at said story threshold and including a tag for actuating said masking plate.

5. The apparatus according to claim 4, said masking plate pivoting about a pin and said tag being actuatable by said story door.

6. The apparatus according to claim 1 further comprising:

a device for ascertaining a coarse position of an elevator in relation to each story according to a learning journey of said elevator cage and a positioning device for ascertaining an exact target position according to a manual learning journey;

said elevator being positioned in said exact target position according to individual light beams being interrupted by one of a plurality of masking plates and a correction magnitude determined by an actual value of a travel command and a target value related to said exact target position of the manual learning journey.

7. The apparatus according to claim 2 further comprising:

a second transmitter strip parallelly arranged adjacent said receiver strip;

a first receiver diode, a second receiver diode, and a transmitter diode arranged on said masking plate, wherein said first receiver diode for receiving a light beam from said transmitter strip, said second transmitter strip and said second receiver diode transmit data in a first direction, and said transmitter diode and said receiver strip transmit data in a second direction;

a story computer for receiving data transmitted to said second receiver diode and for transmitting data via said transmitter diode; and a cage computer for receiving data transmitted to said receiver strip and for transmitting data via said second transmitter strip.

8. An apparatus for use in an elevator system for positioning an elevator with respect to each of a plurality of story thresholds, said elevator system including an elevator shaft, an elevator cage for traversing said elevator shaft and a plurality of stories, each of said stories including a story threshold, said apparatus comprising:

a light curtain comprising a plurality of light beams formed within said elevator cage and parallel to said story threshold;

a plurality of masking plates, each positioned for interrupting at least one of said plurality of light beams, said at least one interrupted light beam indicative of an actual position of said elevator.

9. The apparatus according to claim 8, one of said plurality of masking plates being mounted on each of the story thresholds.

10. The apparatus according to claim 8, said light curtain comprising a plurality of light transmitters and a plurality of light receivers; and further comprising a cage controller for receiving a signal from each of said plurality of light receivers.

11. The apparatus according to claim 10, further comprising:

an elevator controller for receiving a signal from said cage controller, for determining a coarse position of said elevator, and for determining a correction magnitude.

12. The apparatus according to claim 11, said correction magnitude for accurately positioning said elevator in said elevator shaft from said determined coarse position.

13. The apparatus according to claim 8, further comprising:

a plurality of second light transmitters mounted to said elevator cage adjacent said plurality of light receivers;

each of said plurality of masking plates comprising a first receiver for receiving said at least one interrupted beam, a first transmitter for transmitting a predetermined signal to a masked light receiver, and a second light receiver for receiving a signal from at least one of said plurality of second light receivers.

14. The apparatus according to claim 13, further comprising:

a story computer;

a cage computer;

said story computer coupled to said second receiver for receiving a signal transmitted from said cage computer;

said cage computer coupled to said plurality of light receivers for receiving a signal from said story computer.

15. The apparatus according to claim 14, said first transmitter and said plurality of second transmitters for transmitting pulse data.

16. The apparatus according to claim 8, said masking plate comprising an open and a closed position.

17. The apparatus according to claim 16, said masking plate, in said open position, operating as a safety element; and said masking plate, in said closed position, operating as an elevator positioning element.

18. The apparatus according to claim 2 further comprising:

a device for ascertaining a coarse position of an elevator in relation to each story according to a learning journey of said elevator cage and a positioning device for ascertaining an exact target position according to a manual learning journey;

said elevator being positioned in said exact target position according to individual light beams being interrupted by one of said plurality of masking plates and a correction magnitude determined by an actual value of a travel command and a target value related to said exact target position of the manual learning journey.

19. The apparatus according to claim 5 further comprising:

a device for ascertaining a coarse position of an elevator in relation to each story according to a learning journey of said elevator cage and a positioning device for ascertaining an exact target position according to a manual learning journey;

said elevator being positioned in said exact target position according to individual light beams being interrupted by one of said plurality of masking plates and a correction magnitude determined by an actual value of a travel command and a target value related to said exact target position of the manual learning journey.

* * * * *